United States Patent [19]

Warner et al.

[11] 4,064,644

[45] Dec. 27, 1977

[54] FRAME CONSTRUCTION AND CORNER CLIP APPARATUS

[75] Inventors: Richard F. Warner, Fort Lee; William Billand, Montville; Riggi Vincent, Union, all of N.J.

[73] Assignees: Arthur Dash; Jay Reidel, both of Bronx, N.Y. ; part interest to each

[21] Appl. No.: 686,319

[22] Filed: May 14, 1976

[51] Int. Cl.[2] ..... E04C 2/38

[52] U.S. Cl. ..... 40/152; 52/656; 52/658; 29/513; 29/526 R

[58] Field of Search ..... 52/658, 656, 753 H, 52/758 H; 40/152; 29/513, 526

[56] References Cited

U.S. PATENT DOCUMENTS

| | | | |
|---|---|---|---|
| 1,836,354 | 12/1931 | Abrams | 52/758 H |
| 2,101,349 | 12/1937 | Sharp | 52/657 |
| 2,185,904 | 1/1940 | Stowe | 52/758 H |
| 3,315,431 | 4/1967 | Yake | 52/658 |
| 3,484,126 | 12/1969 | Hook | 52/758 H |
| 3,523,703 | 8/1970 | Handley | 52/758 H |
| 3,677,433 | 7/1972 | Collins | 52/758 H |
| 3,736,684 | 6/1973 | Grad | 40/152 |
| 3,802,105 | 4/1974 | Bendix | 40/152 |
| 3,820,298 | 6/1974 | Kirsch | 52/656 |
| 3,888,063 | 6/1975 | Frantz | 52/656 |

FOREIGN PATENT DOCUMENTS

| | | | |
|---|---|---|---|
| 649,455 | 1/1951 | United Kingdom | 40/152 |
| 13,262 of | 1910 | United Kingdom | 52/658 |
| 556,595 | 4/1942 | United Kingdom | 52/656 |

*Primary Examiner*—Price C. Faw, Jr.
*Assistant Examiner*—Henry Raduazo
*Attorney, Agent, or Firm*—Arthur L. Plevy

[57] ABSTRACT

There is disclosed a picture frame which is fabricated from a single piece of an extruded metallic member which has an "F" shaped cross section. The member is suitably notched at predetermined intervals and bent at scored lines. The opposite ends of the member serve to form a non-continuous corner and are joined and secured together by means of an "L" shaped bracket which coacts with the material of one of the flanges of said F shaped member to rigidly secure the entire assembly. It will be shown pursuant to this invention that only one bracket need be used since each of the other three corners of the frame are integrally formed from said common extruded metallic member.

1 Claim, 9 Drawing Figures

FRAME CONSTRUCTION AND CORNER CLIP APPARATUS

BACKGROUND OF THE INVENTION

This invention relates to improvements in frames, particularly the type of frames which are generally used to support pictures, photographs and similar materials.

Basically, the prior art is replete with a great number of patents which concern frames of all sorts and sizes. It has been a primary object of the prior art to provide a frame which is attractive in appearance, is relatively rugged and is simple and economical to build and fabricate. Thus, frames have been fabricated from all sorts of materials including wood, plastic and metals. The general object, as above indicated, is to provide a frame which is aesthetically attractive and which can be fabricated simply and economically.

In regard to the fabrication of such frames, there is a great deal of prior art which show various techniques for securing the side members of the frame one to another. These patents and prior art involve the use of various clip devices in order to formulate a generally rectangular frame configuration which presents a pleasing aesthetic view to a user.

Examples of such typical patents which employ various clips in conjunction with frames may be had by referring to patents as U.S. Pat. No. 2,804,952 entitled WINDOW FRAME CORNER CLIP by K. F. Nothdruft. Other patents as U.S. Pat. Nos. 3,294,429, 3,797,194, 3,883,974 and 3,828,401 shows various mechanisms and apparatus for joining the corners of the frame members to provide a relatively rigid and composite frame assembly.

It is an object of the present invention to provide an improved frame construction which utilizes a minimum of parts and includes an L shaped corner clip for securing two sides of the frame together. The frame, as described, is fabricated from an integral piece of an extruded metal member which may, for example, be aluminum or some other metal alloy which is capable of being easily and economically extruded.

DESCRIPTION OF PREFERRED EMBODIMENT

A picture frame fabricated from an integral piece of extruded material of an F shaped cross section, said material including V shaped notches spaced according to the length and width of a frame to be provided, means located on said extruded member adjacent said notches to enable bending of said notches to provide a rectangular configuration having three angles integrally formed and means including an L shaped bracket positioned between the upstanding flanges of said F shaped member to secure the opposite ends together to thus form a fourth angle of said rectangular picture frame.

DETAILED DESCRIPTION OF FIGURES

Figures 1, 2, 3, 4, 5, 6, 7, 8, 9:
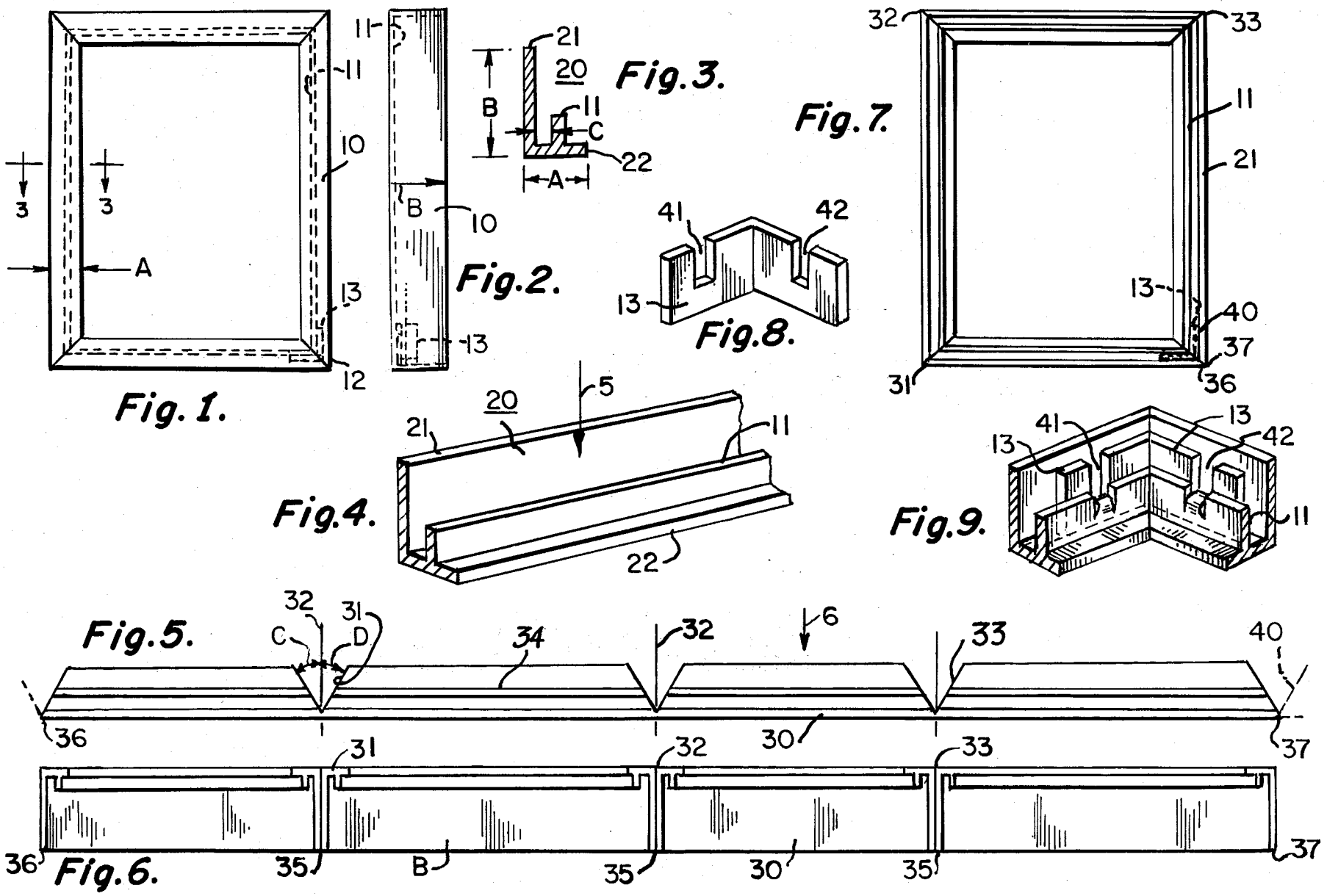
FIG. 1 is a front view of a frame according to this invention.
FIG. 2 is a side view of the frame of FIG. 1.
FIG. 3 is a cross sectional view taken through line 3—3 of FIG. 1.
FIG. 4 is a perspective view of a typical extruded member.
FIG. 5 is a top view of the member of FIG. 4 after the formation of shaped notches.
FIG. 6 is a top view taken in the direction of arrow 6 of FIG. 5 depicting scored bending guide lines.
FIG. 7 is a rear view of the frame after bending.
FIG. 8 is a perspective view of the L shaped bracket to join the ends of the frame.
FIG. 9 is a partial cross section view depicting the emplacement of the L shaped bracket by indentation of an integral flange according to this invention.

Referring to FIG. 1, there is shown a front view of what appears to be a conventional frame, but is a frame 10 according to the principles of this invention. As such, the frame 10 is preferably fabricated from an extrudable material such as anodized aluminum or another metallic alloy.

As can be seen from the front view, the frame appears conventional and has a smooth appearance.

FIG. 2 shows a side view which is typical of any of the four sides of the frame in that there are no screws, rivets or any fastening devices which can be viewed by a user.

The frame 10 of FIG. 1 is fabricated from a single piece of an extruded aluminum member, which member possesses an internal flange depicted as flange 11 (dashed line) of FIG. 1.

Since the frame 10 is fabricated from a single piece of metal, as will be explained, the unit has only to be joined in one corner. Thus shown in corner 12 of the frame in dashed lines, is an L shaped bracket 13 which as will be explained, is positioned between the flange 11 and the edge of the frame and serves to firmly join the adjacent corners of the frame together. The use of this clip and the manner in which it serves to join the ends avoids the use of any typical prior art fastening means, such as rivets, screws, bolts and so on which would be readily visible and detract from the overall appearance of the frame. Thus the frame 10, as indicated, has no projections on the side or front surfaces and appears as a relatively smooth and uniform structure.

Referring to FIG. 3, there is shown a cross section of a typical extruded member 20, which as will be explained, is utilized to provide the entire frame. The member 20 has a first upstanding flange 21 which is at a ninety degree angle with respect to the base 22. A smaller flange 11 which is relatively parallel to flange 21 is also shown and constitutes the inner flange discussed above.

Basically, the length of the base 22 determines the dimension A, as shown in FIG. 1, which is the width of the frame from a front view. The dimension B determines the width of the frame from a side view.

As can be seen from FIG. 3, the member 20 has an F shaped cross sectional view and it is, of course, noted that the typical dimensions of the flanges can vary according to the size of the particular type of frame that one wishes to provide. In a typical application, dimension A may be approximately 0.4 of an inch while dimension B may vary anywhere from one-half inch to three-quarters of an inch. It is, of course, understood that these dimensions can vary according to the type of frame that one wishes to provide. Typically, the distance C between the flange 11 and the flange 21 is about 0.07 to 0.09 inches and hence, flange 11 is relatively close to flange 21.

FIG. 4 is a perspective view showing the elongated member 20 having a cross section as depicted in FIG. 3. As indicated, the member 20 is extruded and may be anywhere from one foot to ten or more feet or longer, again depending upon the dimensions of the frame to be fabricated as to the length and width of the same. Thus, an elongated extruded aluminum member as 20 of FIG. 4 is used to fabricate the frame as depicted in FIG. 1.

Referring to FIG. 5, there is shown a top view of a member 30 (as 20 of FIG. 4). The member 30 is cut at predetermined distances.

As can be seen from FIG. 5, V shaped notches as 31, 32, 33 are cut or otherwise machined at the intervals shown along member 30. Each cut-out constitutes a ninety degree angle. For example, the cut-out 31 has drawn therethrough a reference line 32. The angles designated as C and D are at forty-five degrees with respect to line 32. The cut is made through the flange 34 as well. The flange 34, of course, corresponds to flange 11 of FIG. 3.

FIG. 6 shows a view of member 30 looking down in the direction of arrow 6 of FIG. 3. As can be seen from FIG. 6, the flange as B of FIG. 3 is then scored at the bottom part of the V and relatively perpendicular to the flange 34. The scoring is done by a conventional tool and thus, a small V shaped notch as 35 is formed across the flange B as shown.

It is now noted that any length of material can be treated accordingly. If a rectangular frame is to be provided, then the notches as 31, 32 and 33 of FIG. 4 would be formed as follows:

The distance between edge 36 of member 30 and notch 31 would be short as one side of the rectangle. The distance between notch 31 and notch 32 would be long as the next side of the rectangle. The distance between notch 32 and notch 33 would be the same distance as between edge 36 and notch 31 and thus be short, while the distance between notch 33 and the opposite end 37 of member 30 would be long.

It thus can be seen that a square frame can be produced by making the distances between the notches equal as well as any rectangular shape desired, by alternating the length of the material between notches, as depicted above.

It is also seen that both the ends 36 and 37 are cut at angles of forty-five degrees as shown. For example, near end 37 is shown a dashed line 40 which would constitute a portion of an additional length of extruded material. This is broken off, as indicated, to form the ends 36 and 37 of the frame.

It thus can be seen and determined from FIG. 6 that the notches as 35 in conjunction with the V shaped notches 31, 32 and 33 are then bent to form a composite frame as depicted, for example, in FIG. 7.

It can be seen from FIG. 7 that the frame will be formed by merely bending the material as shown in FIGS. 5 and 6 about the scored lines as 35. Due to the angles included in each of the V shaped notches 31, 32 and 33 of FIG. 7, a rectangle or square frame will be provided. Since the material at the corners 31, 32 and 33 of FIG. 7 is continuous, the frame will be integrally formed at those three corners. When the edges 36 and 37 are placed together, these edges are not joined and hence, shown in FIG. 7 is the L shaped bracket 13. The bracket 13 may be fabricated from aluminum, plastic or some other type of material and basically has a configuration as shown in FIG. 8. The L shaped bracket has two apertures as 41 and 42, both located on respective sides of the L. The bracket is inserted between the outside edge or flange as 21 of FIG. 3 and the inside edge or flange as 11 of FIG. 3. The material comprising the flange 11 is then indented into or swaged or otherwise forced into the aperture as 41 and 42 of the L shaped bracket 13. This affords an accurate and reliable corner locking device for the frame.

FIG. 9 is further included to show one the exact nature of the locking mechanism afforded by the L shaped bracket 13. It can be ascertained from FIG. 9 that the bracket 13, once emplaced, is secured to the frame by the indentation of flange 11 material into the aperture to securely lock the same together to thus form a composite, rugged frame assembly.

It is noted that a great many typically known machining techniques can be employed to fabricate the V shaped notches as 31–33 of FIG. 5, as well as the scored notches as 35 of FIG. 6. It is also apparent that a number of techniques can be employed to force or indent the flange 11 material into the apertures as 41 and 42 of the L shaped bracket 13.

In summation, there is provided a picture frame which is fabricated from a unitary extruded piece of metal which possesses an F shaped cross sectional configuration. The metal is suitably notched and scored at predetermined intervals according to the length and width of the frame to be fabricated. The metal piece is then folded or bent so that a frame is formed with continuous sides. Then ends of the frame are then joined and held securely together by means of a notched L shaped bracket, which is inserted between two upstanding flanges of the F shaped member and held in position by indenting the inner flange material into the apertures of the L shaped bracket.

The resulting frame thus possesses a smoother appearance in regard to all surfaces which can be viewed by a user. As can be seen from any of the above figures, a picture or other material, when inserted into the frame, would rest on the inner surfaces and the entire back of the frame can then be covered with a cardboard or plastic material so that both the flanges and the L shaped bracket are not visible when the frame is accommodating a picture.

We claim:

1. A frame of the type used for displaying a photograph, picture or the like, comprising a unitary elongated member, having an F-shaped cross section thus defining an inner upstanding flange and an outer upstanding flange, said flanges being integrally formed and perpendicular with a bottom surface of a base member, the top surface of said member forming the front of said frame, said frame being fabricated by forming V-shaped notches in said member at selected intervals, said notches formed along the length of said bottom surface of said base member and through said innermost flange, and scored depressions located at the base of said V notch and along the outer-most flange for bending said frame at said scored lines to cause the sides of said "V" notches to coact with each other, thus forming three corners of said frame, with a fourth corner indicative of the opposite ends of said member, means inserted between said first and second upstanding flanges at said fourth corner, said means including an "L" shaped bracket with the arms of said "L" of a substantially greater height than the width and of a greater height than said inner upstanding flange, said bracket including a first elongated aperture transverse to said arm on the top of one arm of said "L" and extending from said top along a major portion of said arm, and a second elongated aperture on the top of said other arm of said "L" and relatively congruent to said first aperture, and indented inner flange material directed through said first and second apertures to firmly secure said frame at said fourth corner.

* * * * *